US008607412B2

(12) United States Patent
Riley

(10) Patent No.: US 8,607,412 B2
(45) Date of Patent: Dec. 17, 2013

(54) CLEANING APPLIANCE

(75) Inventor: Martyn Riley, Newcastle upon Tyne (GB)

(73) Assignee: Black & Decker Inc., Newark, DE (US)

( * ) Notice: Subject to any disclaimer, the term of this patent is extended or adjusted under 35 U.S.C. 154(b) by 30 days.

(21) Appl. No.: 13/484,955

(22) Filed: May 31, 2012

(65) Prior Publication Data

US 2012/0304417 A1 Dec. 6, 2012

(30) Foreign Application Priority Data

Jun. 1, 2011 (EP) ..... 11168516

(51) Int. Cl.
*A47L 9/00* (2006.01)

(52) U.S. Cl.
USPC ..... 15/410; 15/344

(58) Field of Classification Search
USPC ..... 15/344, 410
IPC ..... A47L 9/00
See application file for complete search history.

(56) References Cited

U.S. PATENT DOCUMENTS 8,020,251 B2 * 9/2011 Luebbering et al. ..... 15/410
2007/0033765 A1 * 2/2007 Walker et al. ..... 15/344

FOREIGN PATENT DOCUMENTS

CN 201398936 2/2010
CN 201624601 11/2010
DE 3309162 9/1984

OTHER PUBLICATIONS

EP search report Application No. 11168516.0 dated Mar. 1, 2012.

* cited by examiner

*Primary Examiner* — David Redding
(74) *Attorney, Agent, or Firm* — John Yun

(57) ABSTRACT

There is provided a portable cleaning appliance (100) comprising a main body (102), a nozzle (104) and a graspable handle (106), the nozzle (104) and handle (106) each being movable relative to the main body (102) between a first, storage, position adjacent the main body (102) and a second, in-use, position in which the nozzle (104) and handle (106) extend from the main body (102), wherein the nozzle (104) and handle (106) are connected by a linkage member (128) arranged such that, in use, movement of one of the nozzle (104) and the handle (106) between the first and second positions causes a corresponding coupled movement of the other of the nozzle (104) and handle (106) between the first and second positions.

14 Claims, 7 Drawing Sheets

CLEANING APPLIANCE

The present invention relates to a portable cleaning appliance, more particularly, the present invention relates to a cleaning appliance comprising a nozzle and a graspable handle, each of which is movable between a retracted and an in-use position.

BACKGROUND OF THE INVENTION

A known type of portable cleaning appliance is a hand-held vacuum cleaner. A common type is that manufactured by Black and Decker® under the registered trademark Dustbuster®. Such a hand-held vacuum cleaner has a main body with a suction inlet at a distal end thereof. A suction nozzle extends from the suction inlet to a dust bag for separating dirt and dust from an airflow. A motor and fan arrangement is also provided in the main body together with a power source. A graspable handle is generally located at the rear of the main body.

An alternative configuration of hand-held vacuum cleaner is that manufactured by Black and Decker under the registered trademark Pivot Vac®. Such a hand-held vacuum cleaner comprises a main body including a fixed graspable handle. A suction inlet is located at a distal end of a suction nozzle which leads to separating apparatus such as a cyclonic separator. In this arrangement, the suction nozzle is operable to pivot with respect to the main body so that the suction nozzle can be moved between a stored position and a position in which it can be used to clean a surface.

SUMMARY OF THE INVENTION

According to an aspect of the present invention, there is provided a portable cleaning appliance comprising a main body, a nozzle and a graspable handle, the nozzle and handle each being movable relative to the main body between a first, storage position adjacent the main body, and a second in-use, position in which the nozzle and handle extend from the main body, wherein the nozzle and handle are connected by a linkage member arranged such that, in use, movement of one of the nozzle and the handle between the first and second positions causes a corresponding coupled movement of the other of the nozzle and handle between the first and second positions.

By providing such an arrangement, both the nozzle and handle can be extended or retracted with a single movement of one of those elements. This results in a convenient and smooth operation for a user and a smooth and fast transition between the stored and in-use positions.

In one embodiment, the nozzle and the handle are each pivotally connected to the main body about a respective axis of rotation. A pivotable connection is robust, mechanically efficient and provides smooth movement of the respective components.

In one embodiment, the linkage member is connected directly between the nozzle and the handle at points radially spaced from each respective axis of rotation. This arrangement enables an appropriate moment to be applied to each of the nozzle and handle to assist in the coupled motion therebetween.

In one embodiment, the cleaning appliance further comprises a user-operable catch arrangement operable to lock releasably the nozzle and handle in at least one of the first and second positions. By providing a catch arrangement, the nozzle and handle can be retained in an in-use configuration for cleaning without additional input from a user, or retained in a stored configuration for robustness.

In one embodiment, a resilient member is connected between the linkage member and the main body and arranged to bias the nozzle and handle towards one of the first and second positions when the catch arrangement is released. By providing such an arrangement, the nozzle and handle are urged towards one of the configurations, assisting the user in the transition therebetween.

In one embodiment, the linkage member comprises first and second portions releasably retained in a retained position with respect to one another by a retaining arrangement. By providing such a releasable connection between the parts of the linkage member, an excessive force applied across the linkage member will cause the parts of the linkage member to move with respect to one another rather than undergo breakage.

In one embodiment, the retaining arrangement comprising a first retaining element located on one of the first and second portions and a complementary second retaining element located on the other of the first and second portions. This arrangement enables the first and second portions to be reliably held with respect to one another.

In one embodiment, said first retaining element comprises a recess and the second retaining element comprises a projection engageable with the recess. This configuration is mechanically strong, straightforward to manufacture and robust.

In one embodiment, the retaining arrangement is operable to release the first and second portions from the retained position to enable relative movement therebetween when a force applied between the first and second portions exceeds a pre-determined threshold. This configuration provides a predetermined "abuse force" above which the parts move with respect to one another to prevent damage.

In one embodiment, the first and second portions are slideable with respect to one another once released. This is a convenient arrangement which enables the elements to be easily returned to their original positions.

In one embodiment, one of said first and second portions is slideable within the other of said first and second portions. This is a compact and robust arrangement.

In one embodiment, the linkage member further comprises a resilient member arranged to urge the first and second portions towards the retained position. This assists in returning the parts to the retained position once an abuse force has been applied.

In one embodiment, the nozzle and handle are at least partially recessed in the main body when in the first position. This provides a compact, robust and aesthetically pleasing appearance.

In one embodiment, at least parts of the nozzle and handle lie substantially flush with the main body when in the first position. This enables the cleaning appliance to be provided in a range of shapes and configurations, and is more resistant to damage.

In one embodiment, the cleaning appliance is in the form of a hand-held vacuum cleaner comprising a suction inlet located at a distal end of the nozzle and separating apparatus located downstream of the suction inlet for separating dirt and debris from an airflow drawn in through the suction inlet.

BRIEF DESCRIPTION OF THE DRAWINGS

Embodiments of the present invention will now be described in detail with reference to the accompanying drawings, in which.

DETAILED DESCRIPTION

Figure 1:
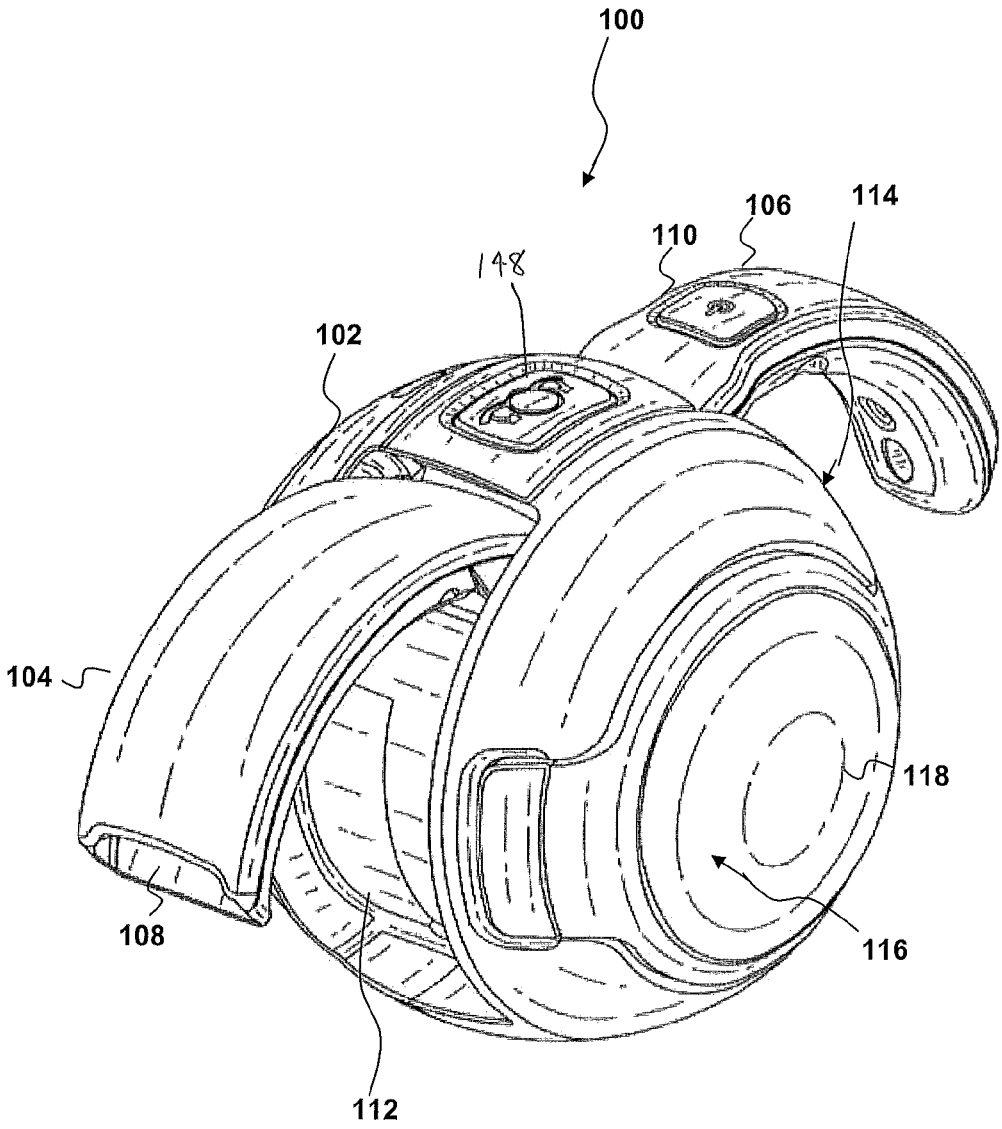
FIG. 1 is a perspective view showing a hand-held vacuum cleaner according to an embodiment of the present invention in an in-use configuration.

The present invention provides a portable cleaning appliance which is operable to provide both a graspable handle and a suction nozzle which are movable between a stored position in which the cleaning appliance is more compact and robust than known arrangements, and an in-use position in which the cleaning appliance can be manipulated comfortably by a user. Further, the present invention provides an intuitive operation mechanism to enable an efficient, easy to use and reliable transition between the stored and in-use positions.

FIGS. 1 to 4 show a hand-held vacuum cleaner 100. The hand-held vacuum cleaner 100 comprises a main body 102 to which a suction nozzle 104 and a graspable handle 106 are attached. The suction nozzle 104 comprises a suction inlet 108 at a distal end thereof.

The handle 106 is dimensioned to fit a user's hand and arranged to enable the hand-held vacuum cleaner 100 to be manipulated in use. The handle 106 includes a power switch 110 which enables a user to switch the hand-held vacuum cleaner 100 on and off. The power switch 110 is positioned such that a user can operate the power switch 110 with the thumb of the hand with which the hand-held vacuum cleaner 100 is being grasped.

Figure 2:
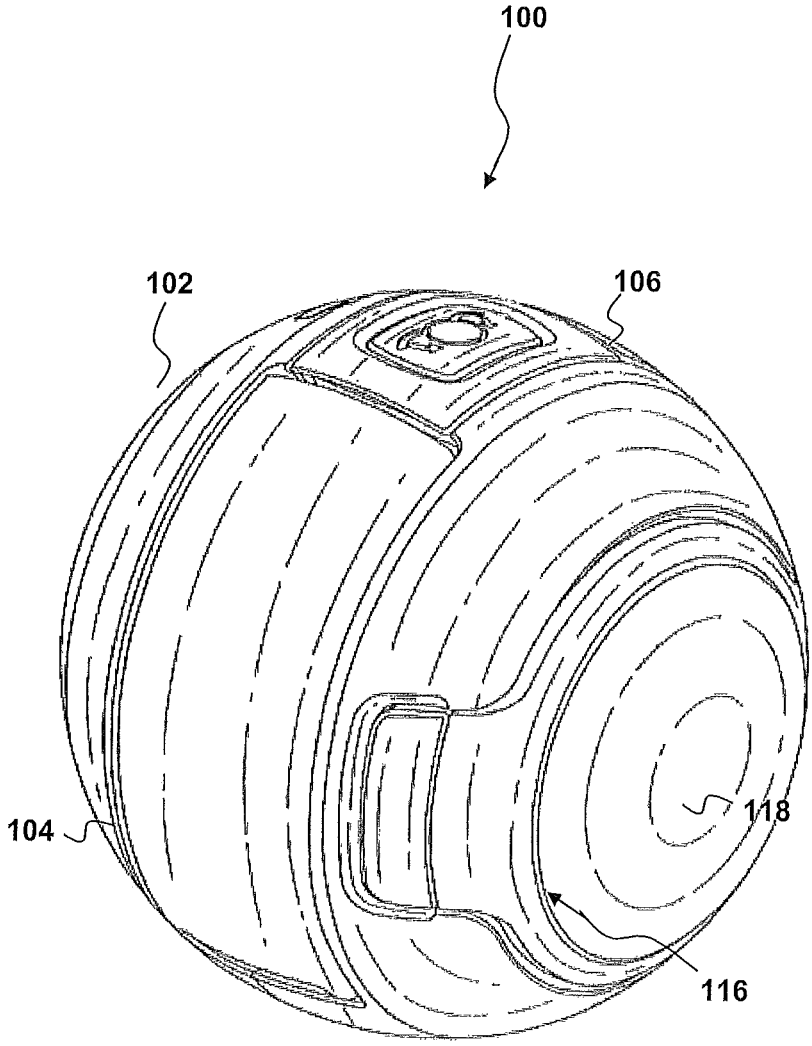
FIG. 2 is a perspective view of the hand-held vacuum cleaner of FIG. 1 in a stored configuration.
Figure 3:
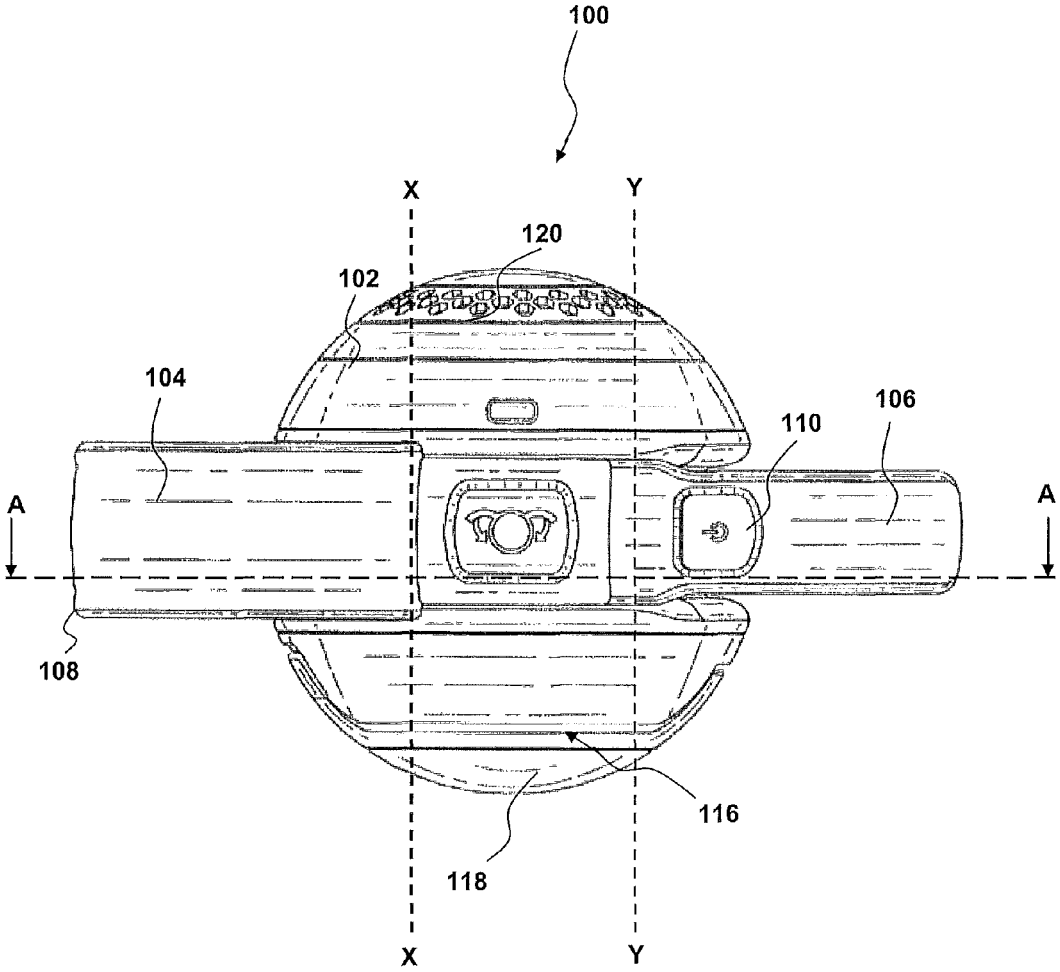
FIG. 3 is a plan view of the hand-held vacuum cleaner of FIG. 1 in the in-use configuration.
Figure 4:
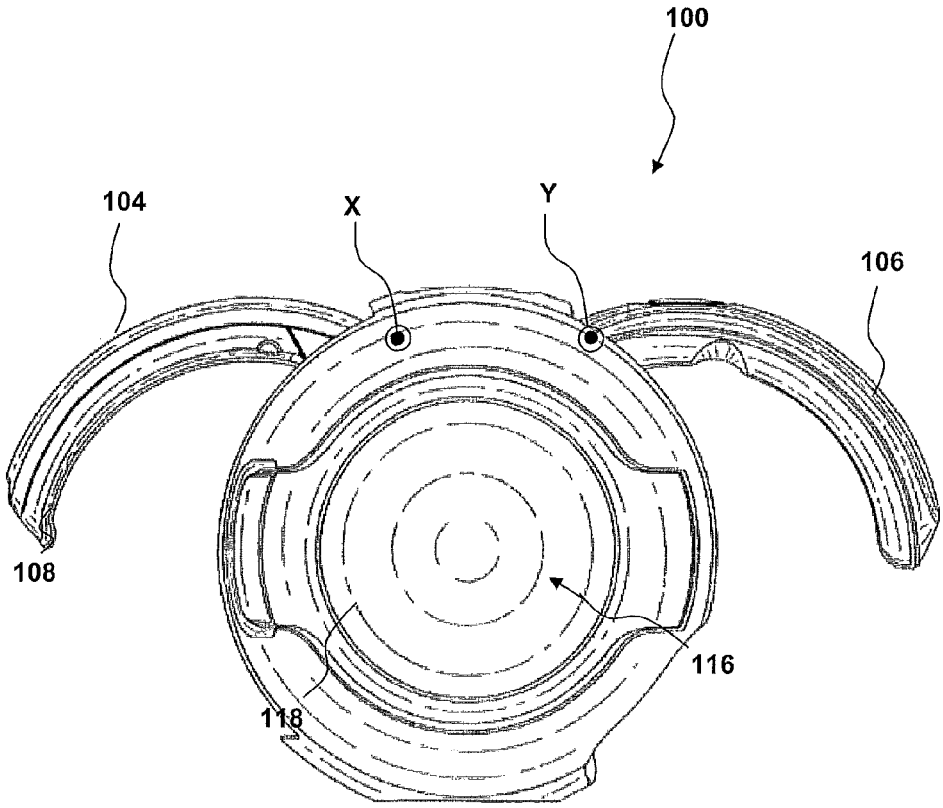
FIG. 4 is side view of the hand-held vacuum cleaner of FIG. 1 in the in-use configuration.

The suction nozzle 104 and handle 106 are movable between stored and in-use positions. FIGS. 1, 3 and 4 show the hand-held vacuum cleaner 100 in an in-use configuration in which each of the suction nozzle 104 and the handle 106 is in an extended, in-use position. FIG. 2 shows the hand-held vacuum cleaner 100 in a stored configuration in which each of the suction nozzle 104 and the handle 106 is in a retracted, storage position.

The suction nozzle 104 and handle 106 are shaped such that, when the suction nozzle 104 and handle 106 are each in the stored position (as shown in FIG. 2), the suction nozzle 104 and handle 106 substantially conform to the shape of the main body 102 to provide a robust and compact configuration for storage, and a pleasing appearance for the user. In this regard, the main body 102 comprises recesses 112, 114 adapted at least partially to receive the respective suction nozzle 104 and handle 106 such that the suction nozzle 104 and handle 106 are at least partially recessed into the main body 102. Further, parts of the suction nozzle 104 and handle 106 lie substantially flush with the main body 102.

The main body 102 comprises separating apparatus 116 for separating dirt and debris from an airflow drawn in through the suction inlet 108. The separating apparatus 116 is in fluid communication with the suction inlet 108 through the interior of the suction nozzle 104. The separating apparatus 116 may comprise any suitable separation arrangement, which may include but is not limited to for example, an inertial separator, a mechanical filter, a porous bag, a cyclonic separator or a combination thereof.

The separating apparatus 116 is operable to collect separated dirt and debris within the interior of the main body 102. In this regard, the separating apparatus 116 comprises a movable cover 118 which is openable to facilitate emptying of collected dirt and debris from the separating apparatus 116.

The main body 102 also comprises a motor and fan arrangement (not shown) downstream of the separating apparatus 116 and an air outlet 120 (best shown in FIG. 3) for exhausting air from the main body 102. An airflow path through the hand-held vacuum cleaner 100 extends from the suction inlet 108, through the suction nozzle 104, the separating apparatus 116, the motor and fan arrangement and to the air outlet 120 where the airflow is exhausted from the main body 102 of the hand-held vacuum cleaner 100.

A power source (not shown) for powering the motor and fan arrangement is also located within the main body 102. In this embodiment, the power source takes the form of a group of batteries located within the main body 102. It is generally useful for a hand-held cleaning appliance to be battery powered to enable cleaning of a wide range of surfaces and locations. However, in the alternative, the hand-held vacuum cleaner 100 may be powered by another source; for example, mains electricity or an in-car charger connection.

Figure 6:
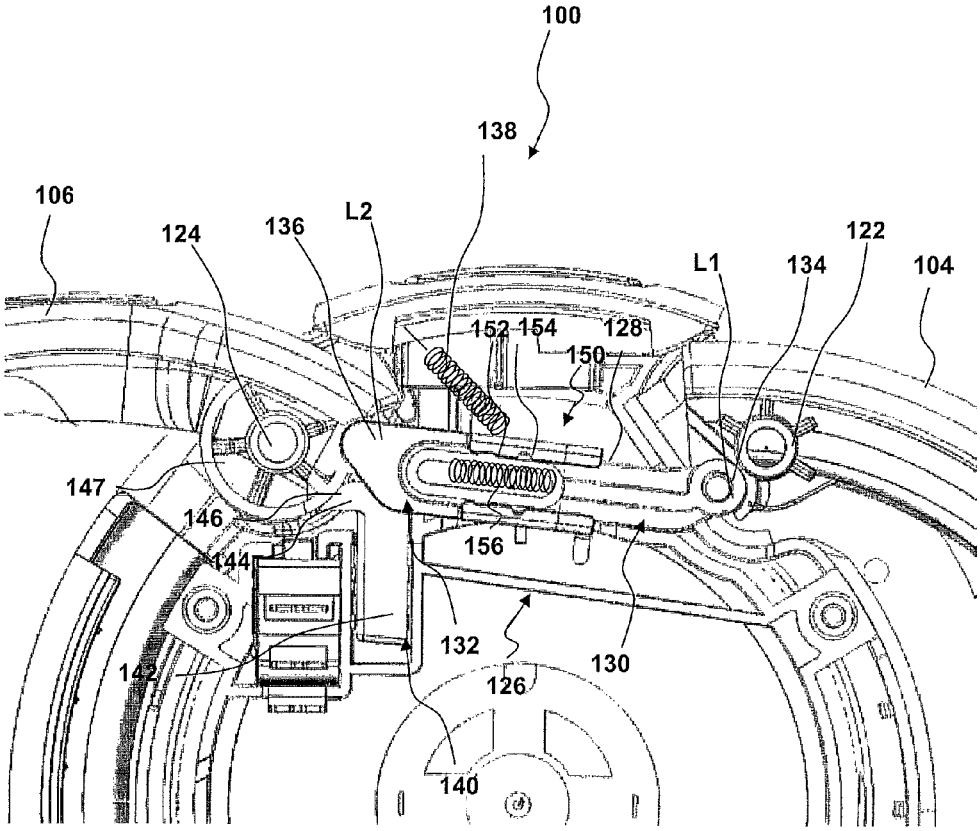
FIG. 6 is a cross-sectional side view, taken along the line A-A of FIG. 3, of the hand-held vacuum cleaner of FIG. 1 illustrating the linkage arrangement in a released configuration.
Figure 7:
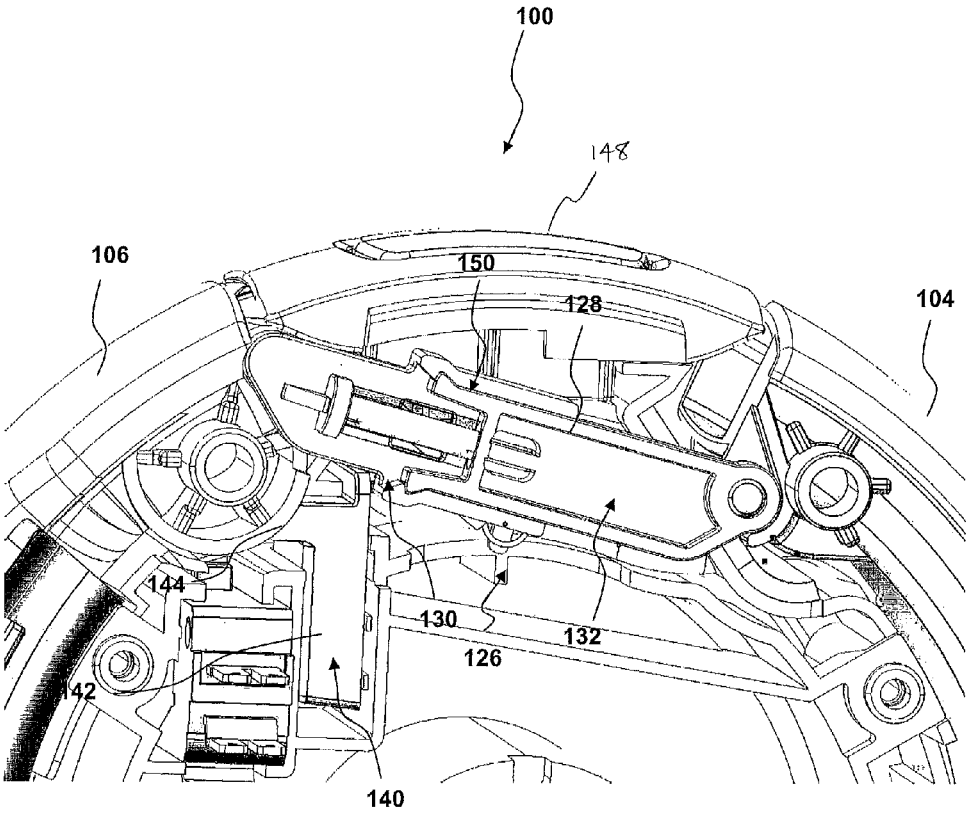
FIG. 7 is an alternative cross-sectional side view of the hand-held vacuum cleaner of FIG. 1 in the stored configuration showing the linkage arrangement in the retained configuration.

The mechanism for enabling movement of the suction nozzle 104 and handle 106 will now be described with reference to FIGS. 5 to 7. The suction nozzle 104 is pivotably connected to the main body 102 by means of a pivot 122 and is pivotable between the stored position and the in-use position about an axis X-X passing through the pivot 122 (this is also shown in FIGS. 3 and 4).

Concomitantly, the handle 106 is pivotably connected to the main body 102 by means of a pivot 124 and is pivotable between the stored position and the in-use position about an axis Y-Y passing through the pivot 124 (this is also shown in FIGS. 3 and 4). In this embodiment, the axes X-X and Y-Y are parallel to one another, although this need not be the case.

A linkage arrangement 126 is connected directly between the suction nozzle 104 and the handle 106. In other words, the linkage arrangement 126 is not directly connected to the main body 102 and is essentially movable independently thereof.

The linkage arrangement 126 comprises a linkage member 128 having a first portion 130 and a second portion 132. The first portion 130 is connected to the suction nozzle 104 about a first linkage connection 134. The first linkage connection 134 comprises a pivotable connection which enables the linkage member 128 to rotate about an axis L1 with respect to the suction nozzle 104. The first linkage connection 134 is radially spaced from the axis X-X (and, thus, from the pivot 122) as will be described later. Therefore, the axes X-X and L1 are parallel to one another and spaced apart.

The second portion 132 is connected to the handle 106 about a second linkage connection 136. The second linkage connection 136 comprises a pivotable connection which enables the linkage member 128 to rotate about an axis L2 with respect to the handle 106. The second linkage connection 134 is radially spaced from the axis Y-Y (and, thus, from the pivot 124) as will be described later. Therefore, the axes Y-Y and L2 are parallel to one another and spaced apart.

In this embodiment, axes X-X, Y-Y, L1 and L2 all lie substantially parallel to one another, although this need not be so.

The linkage arrangement 126 enables the suction nozzle 104 and handle 106 to be movable together. In other words, the linkage arrangement 126 is configured such that movement of one of the suction nozzle 104 and the handle 106 causes a corresponding coupled movement of the other of the suction nozzle 104 and handle 106. This enables a user to, for example, move the handle 106 from the stored position to the in-use position (or vice versa) and cause a corresponding movement of the suction nozzle 104. Therefore, the hand-held vacuum cleaner 100 can be readied for use (or, alternatively, be placed in the storage configuration) with a single movement. This is convenient for the user.

One aspect of this is effected by the connection of the linkage member 128 between the handle 106 and the suction nozzle 104 at points which are radially spaced from the pivot axes X-X, Y-Y. This means that, upon movement of, for example, the handle 106, a moment between the second linkage connection 136 and the pivot 124 will result, causing the linkage member 128 to move with respect to the main body 102. This will result in a corresponding moment on the suction nozzle 104 about the axis Y-Y (resulting from the location of the second linkage connection 134) and, as a result, the suction nozzle 104 will be caused to move.

In order to provide greater convenience for a user, the linkage arrangement 126 is configured to bias the suction nozzle 104 and handle 106 into one of the stored or in-use positions. In this embodiment, the suction nozzle 104 and handle 106 are biased into the stored position. However, it is equally possible to bias these elements into the in-use position.

In this regard, the linkage arrangement 126 comprises a resilient member 138 in the form of a coil spring which extends between a part of the linkage member 128 and the main body 102. When the suction nozzle 104 and handle 106 are moved into the in-use positions (as shown in FIG. 5), the linkage member 128 will move generally downwards (with respect to FIG. 5). Therefore, the coil spring 138 is placed under tension.

Figure 5:
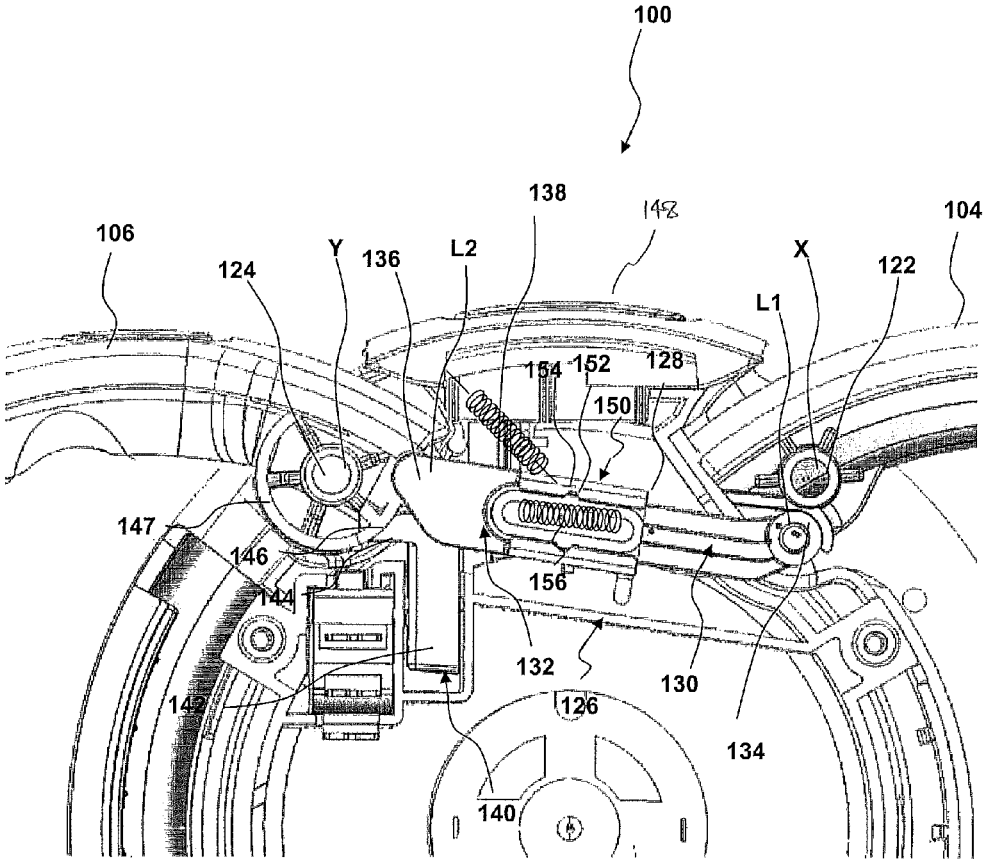
FIG. 5 is a cross-sectional side view, taken along the line A-A of FIG. 3, illustrating a linkage arrangement forming part the hand-held vacuum cleaner of FIG. 1 in a retained configuration.

As a result, in this configuration, the coil spring 138 applies a force on the linkage member 128 to draw the linkage member 128 in a generally upwards direction (relative to FIG. 5). This force will act to move the suction nozzle 104 and handle 106 back into the stored position.

In order to retain the suction nozzle 104 and handle 106 in the in-use position so that a user can use the hand-held vacuum cleaner 100, a catch arrangement 140 is provided. The catch arrangement 140 comprises a linearly movable catch arm 142 having a projection 144 operable to engage with a complementary recess 146 formed in the surface of a cylinder 147 located on the handle 106. The cylinder 147 is located about the axis Y-Y.

The catch arm 142 is biased upwardly (relative to FIG. 5) by a spring (not shown) such that, when the handle 106 (and suction nozzle 104) are extended fully into the in-use position, the projection 144 engages with the recess 146 to retain (or lock) the handle 106 and suction nozzle 104 in the in-use position.

To unlock the catch arrangement 140, a user-operable button 148 is located at an exterior surface of the main body. The button 148 extends into the main body adjacent the projection 144 so that upon actuation by a user against the biasing force of a spring (not shown), the button 148 contacts and moves the projection 144 downwardly and away from the recess 146 and releases the suction nozzle 104 and handle 106 from the in-use position. When this is done, the biasing force of the coil spring 138 acting on the linkage member 128 will cause both of the suction nozzle 104 and the handle 106 to move to their respective stored positions. The nature of this transition (e.g. the speed of the transition) can be adjusted by adjusting the spring force of the coil spring 138.

There is the possibility that a user may attempt to force one of the suction nozzle 104 or handle 106 down whilst the other of those elements is still retained. This may occur, for example, when the user has not realised that the button 148 is required to be depressed and may attempt to force down the suction nozzle 104 back to the stored position. Such an application of force may lead to damage to the linkage member 128 which will experience a compressive force.

In order to reduce the risk of damage to the linkage arrangement 126 and, particularly, the linkage member 128, the first and second portions 130, 132 are movable with respect to one another and releasably retained with respect to one another by a retaining arrangement 150.

The first portion 130 is arranged to slide within the second portion 132. This can be seen by a comparison of FIGS. 5 and 6 (where FIG. 6 shows the first and second portions 130, 132 having been slid within one another).

The retaining arrangement 150 is provided to prevent the first and second portions 130, 132 from sliding with respect to one another unless a particular force (an "abuse force") is applied across the linkage member 128. The retaining arrangement 150 comprises a pair of projections 152 formed on the first portion 130 which engage with a pair of complementary recesses 154 formed in the second portion 132.

The projections 152 and recesses 154 are held in place by friction and the shape of the respective parts. Therefore, the retaining arrangement 150 will only release to enable the first and second portions 130, 132 to move relative thereto when the applied abuse force exceeds the force required to deform the material (in this case, nylon or plastic) of the first and second portions 130, 132 such that the projections 152 can move out of the recesses 154 to enable slideable movement between the first and second portions 130, 132. Slideable movement of the first and second portions 130, 132 prevents breakage of the linkage member 128 when an abuse force is applied.

In order to assist in the return of the first and second portions 130, 132 to the retained position once released, the retaining arrangement 150 further comprises a resilient member 156 in the form of a coil compression spring. The spring 156 applies a force along the length of the linkage member 128 to bias the first and second portions 130, 132 towards the retained position (as shown in FIG. 5).

The spring 156 can also be used to assist the material force of the projection 152 and recess 154 connection and provide a high abuse force to prevent accidental tripping of the mechanism. This also provides a mechanism for accurate fine tuning of the abuse force threshold because a spring force is more readily adjustable than structural material properties.

In use, the hand-held vacuum cleaner 100 is likely to be initially in the stored configuration as shown in FIG. 2. Therefore, the user will lift one of the handle 106 or suction nozzle 104 upwards to bring the hand-held vacuum cleaner 100 into the in-use configuration. Due to the linkage arrangement 126, movement of one of the handle 106 or the suction nozzle 104 will cause a corresponding movement of the other element, which is convenient for a user because the hand-held vacuum cleaner 100 can be placed in the in-use configuration with one movement.

When the handle 106 and suction nozzle 104 are fully extended into the in-use positions, the projection 144 of the catch arrangement 140 will engage with the recess 146 of the cylinder 147 and will retain the handle 106 and suction nozzle 104 in the in-use positions. In other words, the hand-held vacuum cleaner 100 is now ready for use.

The user can then press the power switch 110 to operate the motor and fan unit to draw a flow of dirt- and debris-laden air into the suction inlet 108, through the suction nozzle 104 and into the separating apparatus 116 where the dirt and debris is collected. The air then passes through the motor and fan unit and is exhausted from the main body 102 through the air outlet 116.

When a user has completed a cleaning task, the hand-held vacuum cleaner 100 can be returned to the storage configuration shown in FIG. 2 for convenient and compact storage. This is done by the user pressing on the button 148 which releases the projection 144 from the recess 146. The suction nozzle 104 and handle 106 will then be urged back to the stored positions under the bias of the restoring force of the coil spring 138. This restoring force also maintains the suction nozzle 104 and handle 106 in the respective stored positions. In other words, the coil spring 138 biases the suction nozzle 104 and handle 106 against the main body 102; for example, should the user invert the hand-held vacuum cleaner 100 when in the stored configuration.

Variations of the above embodiments will be apparent to the skilled person. The precise configuration of components may differ and still fall within the scope of the present invention.

For example, the handle and suction nozzle may not be pivotable and may be movable in different configurations, e.g. through the use of a cam or sliding connection. Further, the handle and suction nozzle may be biased into the in-use position, and retained in the stored position.

Additionally, the linkage member need not comprise two sections and may instead comprise a single section.

Further, the present invention is not limited to hand-held vacuum cleaners. Other types of portable cleaning appliance could be used, for example, carpet shampooers, wet and dry machines or blower vacuum devices.

Embodiments of the present invention have been described with particular reference to the examples illustrated. While specific examples are shown in the drawings and are herein described in detail, it should be understood, however, that the drawings and detailed description are not intended to limit the invention to the particular form disclosed. It will be appreciated that variations and modifications may be made to the examples described within the scope of the present invention.

The invention claimed is:

1. A portable cleaning appliance comprising a main body, a nozzle and a graspable handle, the nozzle and handle each being movable relative to the main body between a first storage position adjacent the main body, and a second in-use position in which the nozzle and handle extend away from the main body, wherein the nozzle and handle are connected by a linkage member arranged such that movement of one of the nozzle or the handle between the first and second positions causes a corresponding movement of the other of the nozzle or handle.

2. A cleaning appliance according to claim 1, wherein the nozzle and the handle are each pivotally connected to the main body about an axis of rotation X and Y, respectively.

3. A cleaning appliance according to claim 2, wherein the linkage member is connected directly to the nozzle and the handle at points L1 and L2, respectively, which are spaced from axes X and Y, respectively.

4. A cleaning appliance according to claim 3, further comprising a user-operable catch arrangement operable to releasably lock the nozzle and handle in at least one of the first and second positions.

5. A cleaning appliance according to claim 4, wherein a resilient member is connected between the linkage member and the main body and arranged to bias the nozzle and handle towards one of the first and second positions when the catch arrangement is released.

6. A cleaning appliance according to claim 5, wherein the linkage member comprises first and second portions releasably retained in a retained position with respect to one another by a retaining arrangement.

7. A cleaning appliance according to claim 6, wherein the retaining arrangement comprising a first retaining element located on one of the first and second portions and a complementary second retaining element located on the other of the first and second portions.

8. A cleaning appliance according to claim 7, wherein said first retaining element comprises a recess and the second retaining element comprises a projection engageable with the recess.

9. A cleaning appliance according to claim 6, wherein the retaining arrangement is operable to release the first and second portions from the retained position to enable relative movement therebetween when a force applied between the first and second portions exceeds a pre-determined threshold.

10. A cleaning appliance according to claim 9, wherein the first and second portions are slideable with respect to one another once released.

11. A cleaning appliance according to claim 10, wherein one of said first and second portions is slideable within the other of said first and second portions.

12. A cleaning appliance according to claim 6, wherein the retaining arrangement further comprises a resilient member arranged to urge the first and second portions towards the retained position.

13. A cleaning appliance according to claim 2, wherein the nozzle and handle are at least partially recessed in the main body when in the first position.

14. A cleaning appliance according to claim 2, wherein the cleaning apparatus is a hand-held vacuum cleaner having a suction inlet located at a distal end of the nozzle and a separating apparatus located downstream of the suction inlet for separating dirt and debris from an airflow drawn in through the suction inlet.

* * * * *